United States Patent [19]

Jones

[11] Patent Number: 4,698,978

[45] Date of Patent: Oct. 13, 1987

[54] WELDED CONTACT SAFETY TECHNIQUE

[75] Inventor: Richard D. Jones, Springfield, Va.

[73] Assignee: UHR Corporation, Alexandria, Va.

[21] Appl. No.: 900,586

[22] Filed: Aug. 26, 1986

[51] Int. Cl.[4] ..... F25B 13/00

[52] U.S. Cl. ..... 62/160; 62/126

[58] Field of Search ..... 62/125, 126, 127, 129, 62/130, 160; 165/11; 236/94; 324/421, 422, 423; 361/1, 2, 31, 22, 104

[56] References Cited

U.S. PATENT DOCUMENTS 4,211,089 7/1980 Mueller et al. ..... 62/126 X 4,246,763 1/1981 Mueller et al. ..... 62/160

4,307,775 12/1981 Saunders et al. ..... 62/127 X 4,381,549 4/1983 Stamp, Jr. et al. ..... 62/126

*Primary Examiner*—Harry B. Tanner

*Attorney, Agent, or Firm*—Walter C. Farley

[57] ABSTRACT

A bidirectional heat transfer system including a reversing valve and a compressor has a compressor control which is subject to a welded contact failure. The system is monitored to determine when the control system has signaled for the compressor operation to stop but the compressor has, in fact, continued to operate. Under these circumstances, a safety mode of operation is commenced to keep a load on the compressor to thereby save the compressor from self-destruction. Preferably, this is done by repetitively reversing the state of the reversing valve.

10 Claims, 4 Drawing Figures

1
V*
W
X*
Y*
Z
AA1
AA2
BB1
BB2
CC
DD*
EE
LL
FF*
GG
HH*
II
MM*
NN
JJ*
KK
EXIT
OO*
PP
QQ
RR1
RR2
SS
TT*
UU
EXIT
VV1a
VV1b
VV2a
VV2b
WW*
XX1
XX2
YY
ZZ1
ZZ2
AAA
2
3

WELDED CONTACT SAFETY TECHNIQUE

This invention relates to a method of protecting equipment in a heating and cooling system in the event of a failure in the control system of the type known as a welded contact failure.

BACKGROUND OF THE INVENTION

In any system which uses a compressor for compressing refrigerant, there is some form of control apparatus to energize and deenergize the compressor at appropriate times. This control apparatus can take various forms from the simplest configuration involving little more than a thermostat and a relay to somewhat more sophisticated systems involving multiple relays or, more recently, control devices with programmable microcomputers. Whatever the level of complexity, the last component between the power lines and the compressor is a relay, either electromagnetic or solid state.

With an electromagnetic relay, it is well known that a condition can occur known as welded contact failure. This phenomenon can arise when a current surge occurs as the contacts of the relay are opening. Sufficient heat can be generated to melt the contacts themselves, causing them literally to be welded together in their closed condition. Obviously, when this occurs, the relay has lost all control over the operation of the load being controlled, in this case a compressor, and the compressor continues to run regardless of need. Commonly, there is no load on the compressor after the contacts are welded so the compressor runs itself to destruction unless there are safety devices used. This kind of failure is referred to by the traditional term "welded contact" even if the control system is entirely solid state and, strictly speaking, has no contacts to weld. When it occurs, the nature of the failure in a solid state relay is similar to that in a mechanical relay in that a very low resistance short circuit develops through the solid state relay, forming an uncontrolled path for power to the compressor.

Destruction of a compressor under these conditions can be a catastrophic event. The pressures and temperatures in the compressor are likely to be quite high. Thus, when the machine fails, the result can be an explosion which is dangerous to people in the vicinity as well as to other equipment. For this reason, it has been common to build some form of safety device into the system, such as a ball check valve built into the housing of the compressor itself to bypass the fluid flow and limit the pressure differential which can develop. While this protects against a dangerous explosion, it does not save the compressor which is allowed to continue running and is usually not usable thereafter.

Another form of safety device is a circuit breaker connected to open all of the power lines to the compressor motor in response to excessively high pressure or temperature or high current. While this kind of device is effective, it is very expensive and obviously increases the total cost of the system in which it is employed.

SUMMARY OF THE INVENTION

An object of the present invention is to provide a method for protecting the compressor in a heating or cooling system in the event of a welded contact failure.

A further object is to provide a technique for investigating conditions so that the existence of a welded contact type of failure can be detected before the equipment in the system is damaged, and for thereafter operating the system so as to protect the compressor from catastrophic failure.

Briefly described, the invention includes a method of controlling a heating and cooling system of the type having a compressor and a reversing valve comprising the steps of monitoring selected parameters of the system during normal system operation to determine conditions under which the system compressor should be deenergized. The compressor is watched to determine when compressor operation has not ended under those conditions, thereby indicating the existence of a welded contact failure, and initiating a safety mode of operation when a welded contact failure is indicated. The safety mode includes periodically alternating the state of the system reversing valve to switch the system operation between heating and cooling modes and thereby maintain a load on the compressor until manual corrective action can be taken.

BRIEF DESCRIPTION OF THE DRAWINGS

In order that the manner in which the forgoing and other objects are accomplished in accordance with the invention can be fully understood and appreciated, a particularly advantageous embodiment of the invention will be described with reference to the accompanying drawings in which.

DETAILED DESCRIPTION OF THE PREFERRED EMBODIMENT

Those skilled in the art will recognize from the following description that the method of the invention can be implemented in various ways including the construction of a special control circuit for sensing a welded contact failure and cycling the compressor operation as described herein. However, the most efficient implementation and by far the most preferred is when the method can simply be incorporated into the code of a software control system which already exists for the control of the heating and cooling apparatus. Accordingly, the method will be described in the context of an existing system which is disclosed and claimed in commonly owned patent application Ser. No. 635,140, filed Nov. 27, 1984, now U.S. Pat. No. 4,645,908, , Richard D. Jones, issued on Feb. 24, 1987, the entire content of which is hereby incorporated by reference for all purposes.

Figure 1:
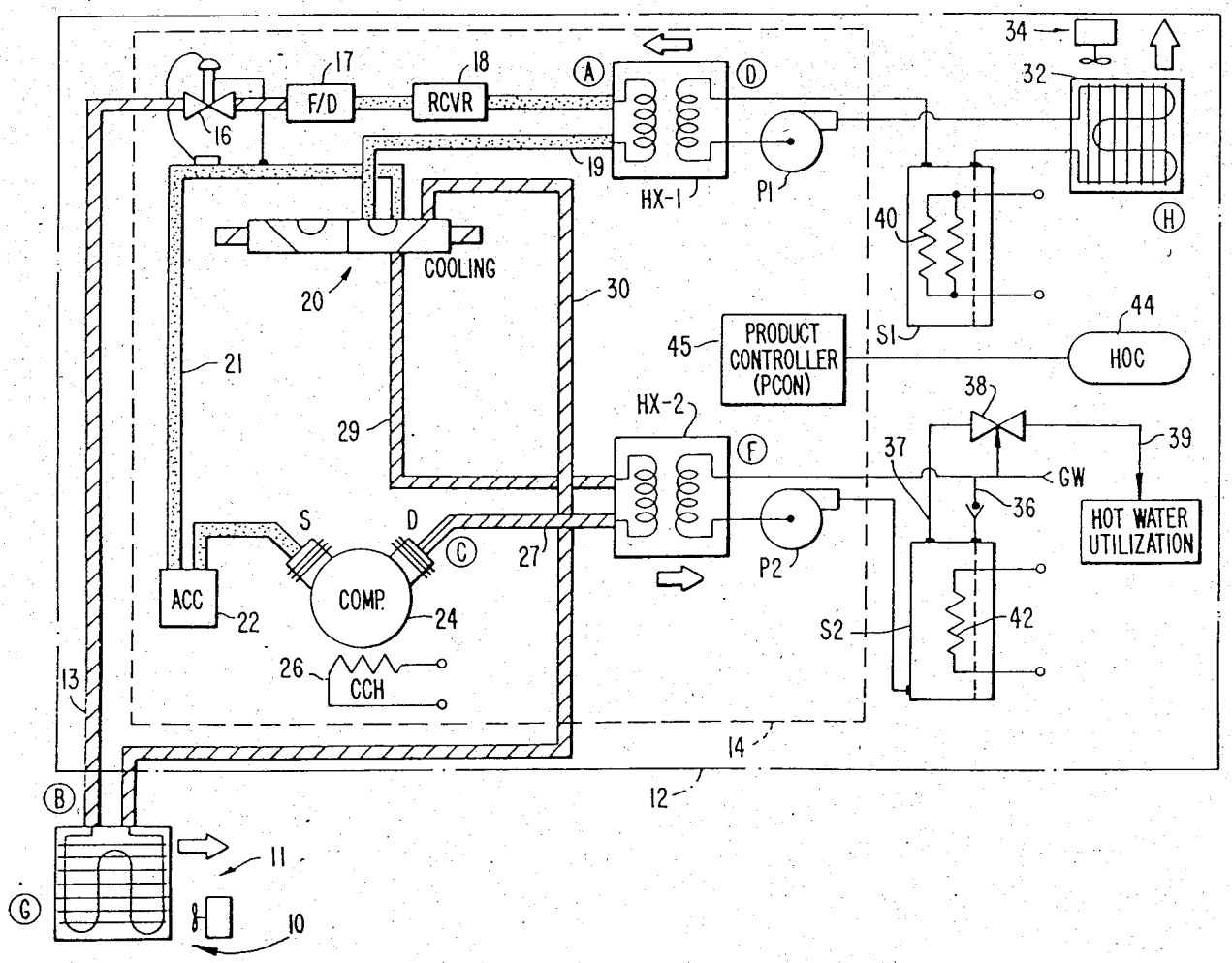
FIG. 1 is a schematic block diagram of a heating and cooling system to which the present invention is applied.

For convenience, FIG. 1 of the above-referenced Jones patent is incorporated as FIG. 1 herein and shows an outdoor air coil indicated generally at 10 having a fan 11 for drawing outdoor air through and across the coil. Coil 10 is a conventional refrigerant-to-air heat exchanger of a type manufactured by several companies in the HVAC field. In the present system, it is positioned physically and thermodynamically in the usual position occupied by this component.

The structure to be heated and cooled by the system is indicated by a dot-dash line 12 which can be regarded as schematically indicating the boundaries of a structure. One end of coil 10 is connected to a conduit 13 which extends into the structure and into a module which will be referred to as the generator module 14, all components within this module being physically located within a single housing in the present system. Conduit 13 is connected to a thermostatic expansion valve 16 which is also a conventional device. In series sequence following the expansion valve are a filter-dryer unit 17, a receiver 18 and one end of the refrigerant side of a refrigerant-to-water heat exchanger HX-1. The other end of the refrigerant portion of exchanger HX-1 is connected through a conduit 19 to a conventional 2-position, 4-way reversing valve indicated generally at 20. Valve 20 is preferably a solenoid-actuated valve under the control of software described in the referenced patent.

Valve 20 is shown in the position occupied in the cooling mode in which conduit 19 is connected through the valve to a conduit 21 which leads to an accumulator 22, and from the other side of the accumulator to the suction side of a conventional compressor 24. As is customary in this field, the compressor is provided with a crankcase heater 26. The discharge side of compressor 24 is connected through a conduit 27 to the refrigerant side of a refrigerant-to-water heat exchanger HX-2, the other side of which is connected through a conduit 29 to the reversing valve. Again, in the cooling mode, conduit 29 is coupled to a conduit 30 which leads to the other side of the out-door air coil.

As will be readily recognized from the schematic illustration of valve 20, in the heating mode conduit 29 is connected to conduit 19 and conduit 21 is connected to conduit 30.

The water circuit connected to the water side of exchanger HX-1 includes a series interconnection of a pump P1, an indoor coil indicated generally at 32 and a heating/cooling water storage container S1, these components being interconnected by suitable piping. Indoor coil 32 is provided with a fan or blower 34 by which return air is drawn through and caused to pass over the coils of exchanger 32 for suitable water-to-air heat exchange to condition the space.

The water side of exchanger HX-2 includes a pump P2 which is connected to draw water through the water side of exchanger HX-2 and deliver water to the lowest portion of a domestic hot water storage container S2. The other side of the water coil of exchanger HX-2 is connected to a ground water supply and to a conduit 36 which extends to the bottom of container S2. At the upper end of container S2 is a hot water outlet 37 which is connected through a tempering valve 38 to the hot water supply conduit 39. It will be observed that conduit 36 is also connected to the tempering valve so that the valve can provide an appropriate mixture of hot and ground water for providing a hot water output of a desired temperature.

Containers S1 and S2 are also supplied with resistive heating elements 40 and 42, schematically illustrated in FIG. 1, so that in appropriate circumstances additional energy can be supplied to the system to heat the water in either or both of the containers. Element 40 is preferably two elements in parallel as illustrated.

It will be observed that exchanger HX-2 is in a position at the output or pressure side of compressor 24 so that it can always be supplied with refrigerant medium at an elevated temperature, providing the capacity for heating the water in container S2 in either the heating or cooling mode, or, if desired, when the system is not being used for either heating or cooling. Each of containers S1 and S2 is preferably a 120 gallon domestic hot water tank, container S1 being supplied with two 4.5 kW heating elements and container S2 being supplied with one 4.5 kW element.

The control software for this system operates the compressor, pumps and fans so that the storage tank is conditioned during off-peak hours of electrical usage, the term "condition" meaning that the liquid therein is heated or cooled, depending upon the position of a mode switch on the homeowner's console (HOC) 44. Thus, the system is ready to heat or cool the space from storage during peak hours, minimizing the peak time use of the compressor. The software can be thought of as existing in a product controller 45 which communicates with various parts of the system, including HOC 44 and also including a plurality of temperature sensors which are represented in FIG. 1 by circled capital letters. Those sensors are important for the various control functions performed on the system. For present purposes, however, the sensors which are of interest are sensor C which responds to the discharge temperature of compressor 24 (t_dis); sensor B which senses the temperature of the liquid manifold at the outdoor coil (t_liq), this being representative of the evaporating temperature in the heating mode and the leaving liquid temperature in the cooling mode; and sensor G which senses the temperature of the outside ambient air (t_amb) at the inlet side of exchanger 10.

The other time functions and parameters used in the system are, of course, available to the portion of the system described herein.

Figure 2:
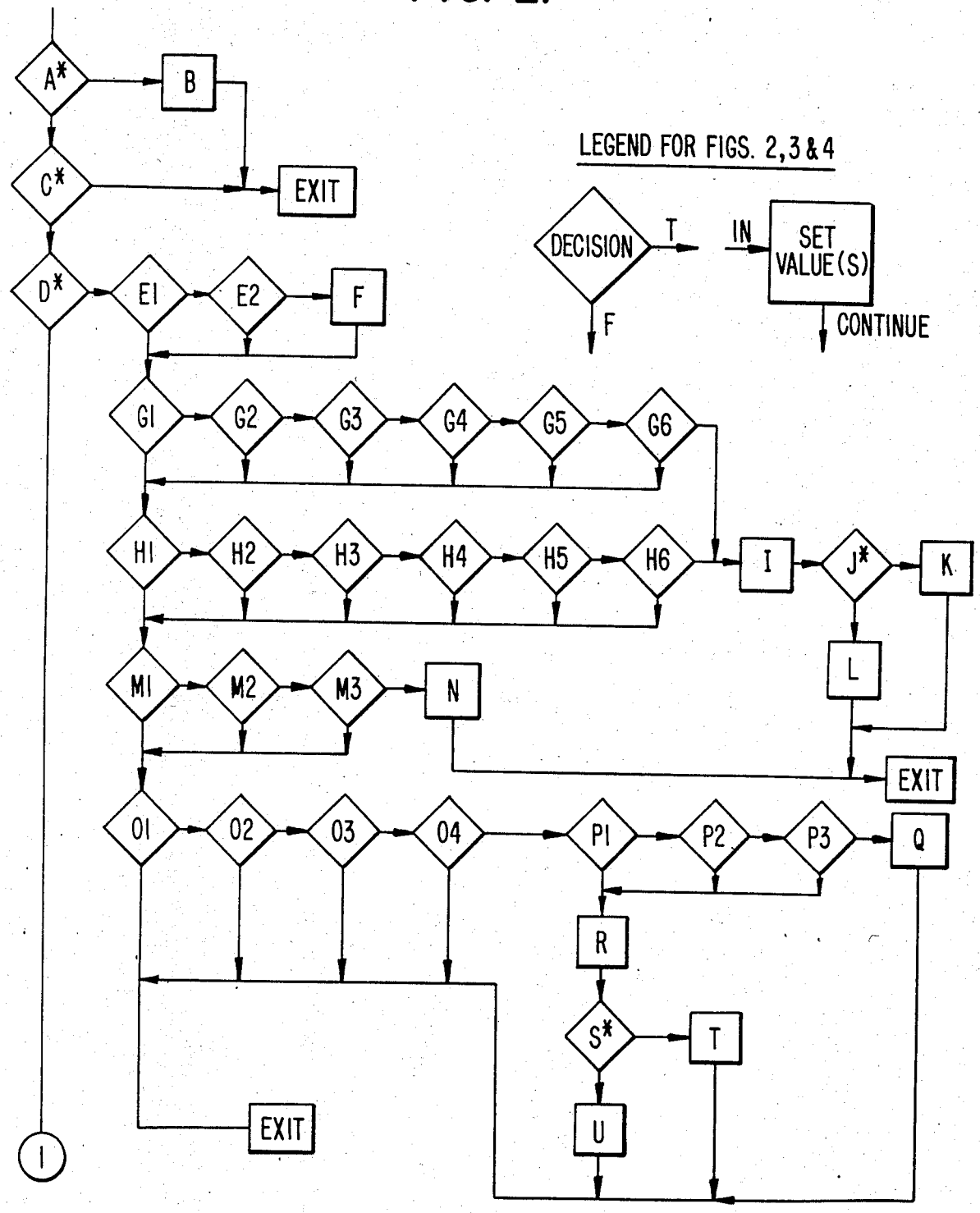
FIGS. 2, 3 and 4, taken together, make up a flow diagram illustrating the steps of one embodiment of the method of the present invention.
Figure 3:
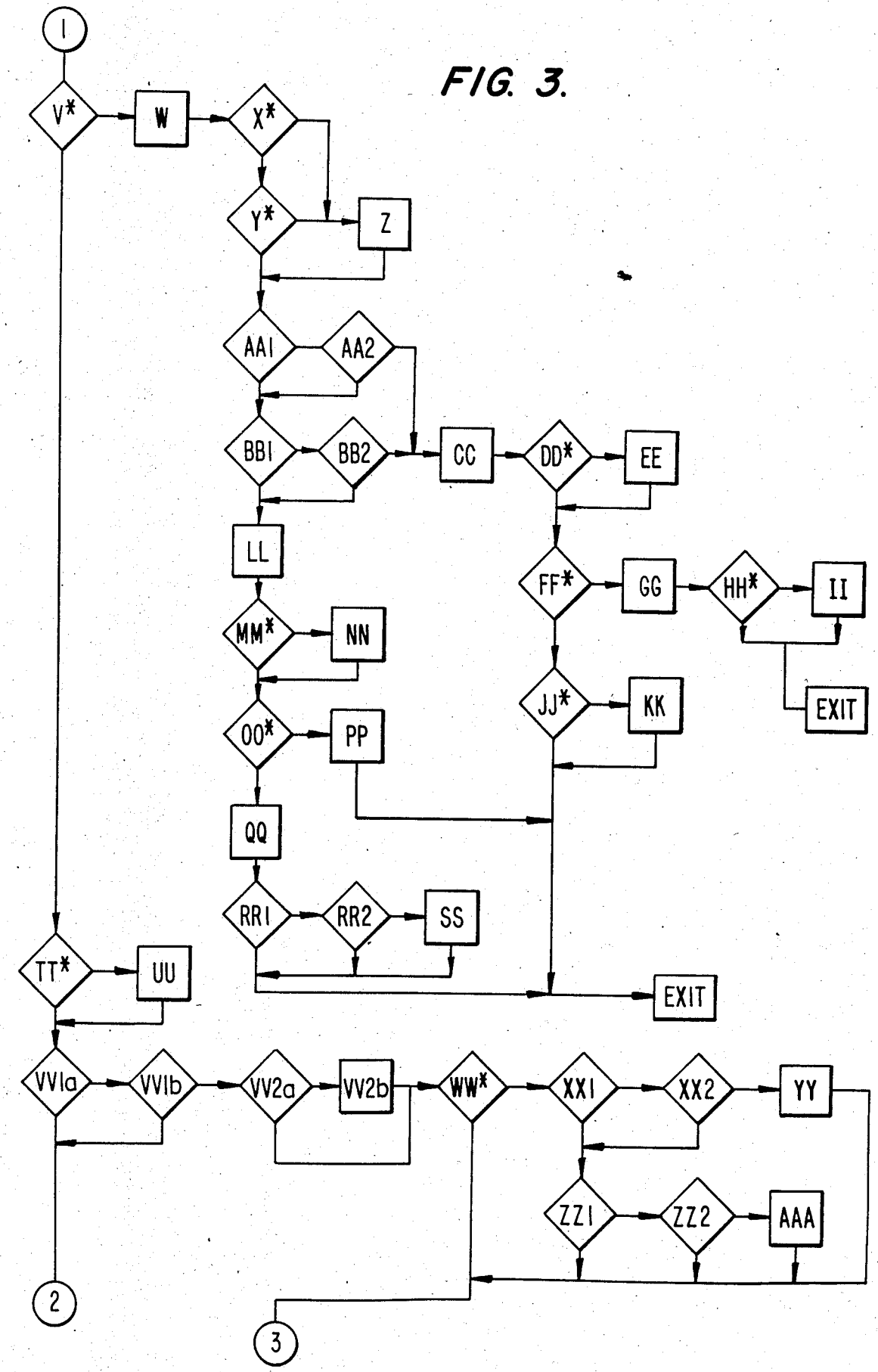
Figure 4:
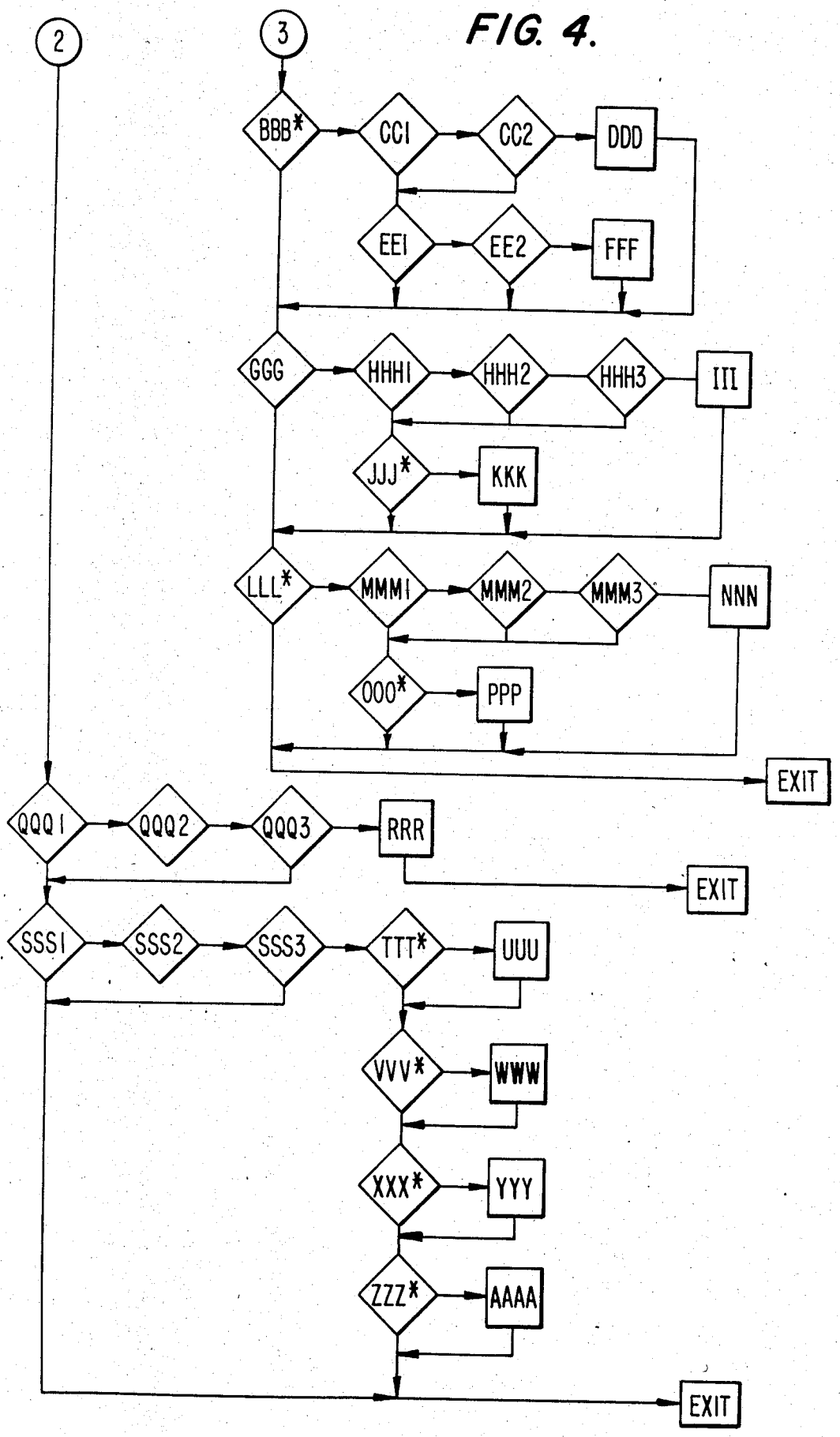

FIGS. 2–4 show a simplified flow diagram illustrating a program for performing the method for determining whether there is a need to establish a "safety" indicating that a welded contact condition exists. In the specific system which is under discussion, the establishment of a safety means that normal operating conditions will be disregarded and the system will be operated in whatever mode is required to deal with the condition which gave rise to the establishment of the safety. The method will be discussed in the context of a program written in C, a listing of which is reprinted at the end of this specification. As part of that listing, the program steps are identified by those symbols which are used in FIGS. 2–4. The symbols, which are not part of the program itself, are in the left-most column.

This method is to monitor selected parameters of the system during operation to determine whether conditions exist which are symptomatic of a welded contact condition. In order to do that, three temperatures are investigated in the context of various system operating modes to see if certain sets of operating conditions exist. If the temperatures under those conditions are what could be expected for normal operation, no safety is set. Conversely, if the detected conditions should not exist, a safety is set and a "save the compressor" mode of operation is initiated.

It is desirable at this time to digress long enough to briefly discuss the concept of requests to enable or disable. The modules which form the parts of the control software for the system of FIG. 1 in which the present invention has been implemented are arranged so that they function almost independently of each other. Each module does its task and produces an output within a certain interval of time, e.g., an epoch. Without regard for whether that output is used or recognized, the module again goes through its own routine in the next epoch. The output can be the result of a calculation which is simply made available for other modules or the output can be a request to do something. That "something" can be to enable or disable a piece of hardware or to set a safety, for example.

Note that the modules do not themselves actually send an actuating command; they simply make requests. It is quite possible for more than one module to request enabling a particular piece of equipment at essentially the same time. It is also quite possible for two modules to make inconsistent requests for quite different reasons. For example, it could be that one module has investigated the temperature of the space to be conditioned and concluded that the compressor should be energized in order to cool the space, but for another module to conclude that the space can be adequately cooled using cold water from the storage tank S1 and that the compressor should not be energized because the time of day is when energy costs are the highest.

All requests are screened through a special module called REDUCTION which, essentially, filters through the multiple requests and determines which of them should be honored. Normally, a request to disable takes precedence over a request to enable, and requests to set safeties are observed first since they can involve potentially hazardous conditions. Then another module called SEQUENCER receives the filtered outputs of REDUCTION and, in accordance with a fixed order of priorities, sends the actual commands which cause items of hardware to be enabled or disabled. Since the present program is involved with the setting of a safety if conditions so indicate, its output would be recognized by REDUCTION and SEQUENCER and acted upon within the epoch or two following the determination that a safety should be set.

The three temperatures which will be investigated are those mentioned above, i.e., the discharge temperature of the compressor, identified as t_dis; the outside ambient temperature, t_amb; and the temperature of the liquid refrigerant in the outside coil which is known as t_liq. These temperatures will also be identified in an upper case form when they involve settings of values in the system, e.g., TLIQ, TDIS, TAMB.

Once again it should be emphasized that this routine is repeated each epoch, i.e., every four seconds, and that the various temperatures in the system are also repeatedly being measured and those measured values are made available to this and other modules. Also, values are being stored or calculated, such as, e.g., the high and low t_liq values over the previous 16 epochs and the average TLIQ. A record is also stored of when certain events were supposed to happen, such as the energization or deenergization of the compressor or a change in the position of the reversing valve.

The first step is see if the time since restart of the entire system is less than 8 seconds (A*). If it is, this indicates that the system is in the special conditions which are characteristic of startup. It is assumed that a welded contact condition does not exist and no safety is set (B).

If the system is not in the startup mode, a check is made to see if a safety has already been set (C*). If so, it is obviously not necessary to continue with the program and the routine is ended.

Next it is determined whether the system is in an epoch which is known as the "initial" epoch (D*). In this system, the control software is organized on the basis of three types of epochs. In normal operation the epochs have fixed durations, about 4 seconds each. However, during startup there are two different kinds of epochs which are treated differently. The first one, which can vary in length from about 4–8 seconds depending upon circumstances, is called the "first epoch". The second kind is called an "initial epoch". A succession of "initial" epochs follow the "first" epoch for an interval of about five minutes during which various system initialization procedures are followed. If it is determined that the system is in an initial epoch (E1), and the time since restart is less than 12 seconds (E2), then it is necessary to establish some initial values for purposes of this program. Thus, the compressor discharge temperature is set at the discharge temperature at that moment and t_liq is set at the liquid temperature at that moment (F). In addition, the system sets requests to enable the pumps P1 and P2, and to disable (i.e., deenergize) the reversing valve, which would put the valve in the heating or defrost recovery mode. The reversing valve mode is set to zero and the time-out flag to FALSE. The time-out flag is used as a time check to be sure that the system has not overlooked or by-passed a dangerous condition. An interval of 10 minutes from compressor shutdown is used. If that interval has passed and the discharge temperature is less than 110°, it is likely that something was missed. This will be seen later in the routine.

If it is determined that the system is in the initial epoch and one of two sets of conditions exist, a safety flag is set. One set of conditions calling for this flag involves the system being in the cooling mode (G1–G6). The program checks to see if TDIS is greater than 140 degrees (all temperatures herein are in Fahrenheit degrees); and TDIS is at least as high as 10 degrees less than the measured t_dis at boot-up; and TLIQ is at least 20 degrees less than the ambient temperature and is also at least 10 degrees less than t_liq at boot-up; and the ambient temperature is above 50 degrees. If all of these conditions exist, a flag is set (I) because the conditions indicate that the compressor is in severe danger.

Alternatively, when the system is in the heating mode (H1–H6), if TDIS is greater than 140 degrees and is also higher than 10 degrees less than t_dis at bootup; and if TLIQ is less than 15 degrees below ambient and less than 5 degrees below t_liq at boot-up when the ambient is less than or equal to 50 degrees, a danger to the compressor is indicated and the safety flag is set (I, J*, K, L).

These sets of conditions for the cooling and heating modes, respectively, represent circumstances which should not ever exist if the compressor is operating properly and the rest of the system is in operative condition, i.e., the coils are unobstructed so that the exchange fluids can pass, the system has an adequate charge of refrigerant, etc. In either mode, the compressor temperature TDIS should drop below 140° quickly and the liquid temperature in the outside coil should increase after boot-up at least 10 degrees in the cooling mode and at least 5 degrees in the heating mode. If these conditions are not met, the system must be regarded as being in danger and a safety is set.

The program then goes through a process of rechecking conditions to zero out registers which may have enable or disable requests remaining. If the time since restart is greater than 4 minutes and TDIS is less than 130 degrees (M1, M2, M3), either the compressor is off the line or there is no refrigerant in the system. In either case, no safety flag is to be set, so the registers for both the enable and disable requests for welded contact safety are set to zero (Na, Nb).

If the system is in a "normal" epoch (not first or initial epochs) and if the time since restart is at least 7 minutes and if both the request to enable a safety and a request to disable a safety because of a welded contact safety condition have been set to nonzero states (01, 02, 03, 04), and if TDIS is less than 140 degrees and is also less than 5 degrees above t_dis at boot-up, and if TLIQ is greater than 15 degrees below TAMB (P1, P2, P3), then the registers holding requests to disable and enable because of welded contact safety are set to zero (Qa, Qb).

If the system is in a normal epoch but not all of the foregoing conditions (P1, P2, P3) are met, the crisis intervention flag is set (i.e., TRUE) and the safety conditions status is set for a welded contact compressor safety in either the heating or cooling mode, depending on the position of the mode switch on the homeowner console HOC 44 (R, S*, T, U).

Proceeding to FIG. 3, if the system is in a normal epoch and the system has been on for more than 7 minutes and 4 seconds, and if the compressor has been turned on, the program sets an enable request for pump P-1 (V*, W). Then, if the time since the last request for a change in the status of either the compressor or the reversing valve is less than 5 minutes, both the high and low liquid temperature to be stored in the system are recorded as being the TLIQ reading at that time (X*, Y*, Za, Zb). If the HOC is set for the cooling mode, or there is a request to enable defrost (AA1, AA2, BB1, BB2), then this routine sets a request to enable the reversing valve (CC). If the stored high liquid temperature is less than the current value of TLIQ, then the high t_liq is set to that current value (DD*, EE).

If the conditioning mode is the cooling mode as selected by the HOC switch, the reversing valve mode is set to cooling (FF*, GG).

Then, if the compressor has been on for a multiple of exactly 15 minutes, the high TLIQ is set to the calculated TLIQ average (HH*, II). In other words, this is set every 15 minutes of compressor operation. Otherwise, since it is possible that the cooling switch is off, if the reversing valve mode is heating, it should be set to defrost (JJ, KK).

Else, the reversing valve must be off. At this point the logic must guarantee that a bit requesting enablement of the reversing valve is removed if it exists. The request to enable word is therefore masked to remove that bit. If the low t_liq is greater than current TLIQ, then set low t_liq to TLIQ (MM*, NN). If the heat pump is recovering from a defrost cycle, the reversing valve mode is set to Recovery (00*, PP). Otherwise, the routine defaults to the heating mode or "valve off" mode and the reversing valve mode is set to "heating" (QQ). If the time since a change in the valve position is greater than 30 minutes and if the compressor has been on for an exact multiple of 15 minutes, then the low t_liq value is set to the average TLIQ value (RR1, RR2, SS).

In order for the routine to get into the next part of the code, the compressor must be off, i.e., it must have received a command generated by SEQUENCER to turn off (i.e., the FALSE output of V*).

The routine asks when the compressor went off. If the time since it went off is less than 2 epochs, then the "time out" flag is off (false) and the t_dis at shutdown is estimated at (assumed to be) the current TDIS (TT*, UU).

If there is a request to enable other devices (P1, P2) as a protection against a welded contact safety and if the time since a change in the compressor status is less than 10 minutes (VV1a), and then if the water temperature in the indoor coil THX1W is less than 25.5 or greater than 115.5 (VV1b), the request to enable for welded contact safety is ORed with the space fan mask (VV2a, VV2b). The system then looks at temperatures in each of the four possible modes, heating, cooling, defrost and recovery.

If the reversing valve is in the heating mode (WW*), if the compressor discharge temperature is greater than 10° below t_dis at shutdown and if TLIQ is less than 5° below the low t_liq, then a welded contact safety is set and the crisis intervention flag is set to TRUE (XX1, XX2, YY). However, if the discharge temperature has dropped by 10° or more and if the liquid temperature is greater than low t-liq, no safety is set (ZZ1, ZZ2, AAA).

Continuing on to FIG. 4, if the reversing valve is in the cooling mode (BBB*), if the compressor discharge temperature is greater than 10° below t_dis at shutdown and if TLIQ is at least 5° above the high t_liq, then a welded contact safety is set and the crisis intervention flag is set to TRUE (CC1, CC2, DDD). However, if the discharge temperature has dropped by 10° or more and if the liquid temperature is less than high t_liq, no safety is set (EE1, EE2, FFF).

If the reversing valve is in defrost mode (GGG*), if the compressor discharge temperature is 2° or more above t_dis at shutdown, if the liquid temperature is 10° or more above the stored high t_liq and if the high t_liq is above 45°, then a safety is set (HHH1-3, III). However, if the discharge temperature is at least 20° below shutdown temperature, set no safety (JJJ*, KKK).

Finally, if the reversing valve is in the "recovery from defrost" mode (LLL*), if TDIS is above shutdown temperature minus 10°, if TLIQ is more than 15° below the stored low and if more than 5 minutes has passed since the state of the compressor has been changed, then a safety is set (MMM1-3, NNN). But if the discharge temperature is below 20° below shutdown, set no safety (OOO*, PPP).

The foregoing several paragraphs have dealt with the condition in which the compressor had been commanded to shut off. If the time since the compressor was turned off is 10 minutes or more and if there is a request to enable a welded contact safety and if TDIS is no more than 100°, no safety is set and the time out flag is set to TRUE (QQQ1-3, RRR). However, if there is no request to enable a safety and the time-out flag is true and the discharge temperature is over 110°, then this indicates that something may have been by-passed, as indicated above and a safety is set (SSS1-3).

The "formal" manner in which the safety is set when the time-out flag is true, i.e., whether it is identified as a safety in the heating, cooling, defrost or recovery mode, is determined by the final portions of the code.

Setting a safety in any mode causes the compressor and reversing valve to enter a mode of operation in which the valve position is reversed at regular intervals. This is a simple timing and switching operation, the result of which is to always keep a load on the compressor, never allowing it to reach the extreme temperature and pressure conditions which would otherwise be reached and which might cause the compressor to eventually self-destruct. In the present system, the reversing valve is reversed until the system can be manually deenergized.

The program listing for this "save the compressor" routine is included at the end of the welded contact safety routine. No flow diagram is provided because of the shortness and simplicity of this routine. The basic purpose of the "save the compressor" routine is to recognize the crisis intervention flag and to operate the system so that a load is always on the compressor. In the present system, the load is maintained by alternately heating and cooling the space 12. It would also be possible to alternately heat and cool storage tank S1 and, in other systems, other loads could be used. It will be noted that the listing actually refers to conditioning the storage because it was originally written to do so. These terms have subsequently been redefined to act on the space.

The crisis intervention flag and safety are looked at in the SEQUENCER module, discussed above. When the flag is set, this routine is implemented. If the flag is "1", the system goes into a "condition the space" mode which is either heating or cooling. The first thing the routine does is look to see which mode the system was in. It is preset to assume the heating mode, but then the welded contacts safety routine is checked to see whether the system is in defrost or heating. In either case, the mode is immediately changed to cooling. The reason for this is that, first, we want the system to go to the opposite of what the current status has been. If the system has been in defrost mode, the coil still must be defrosted by transferring energy to the coil. If the system was in heating, the storage tank and space are probably hot, so cooling should be started.

The next conditional statement sets the device contacts. If the system is put into cooling mode, everything is set for cooling including pumps P1 and P2, the outside air fan, the reversing valve and the inside space fan. Note that there is no activation of the compressor because either it is already on, which is the reason for being in this routine, or else a mistake has been made. In either case, we do not want to activate the compressor. The "else" of this condition is similar for the heating mode.

For purposes of this routine, certain limits are established for both cooling and heating. The next part of the routine checks to see if these boundaries have been exceeded in either direction. Thus, if the temperature of the return air TRETA is less than equal to the HOC panel setting minus 5°, or if it is less than 65D, the mode is changed to heating and the device contacts are appropriately set. Similarly, starting in heating, the space is only heated to 78° or to 5° above the HOC panel setting, whichever is less.

The remaining portion of the code is the portion in which a digital output word is actually created by generating "high byte" and "low byte" segments. Each is 16 bits long and is recognized as part of the system digital output. The crisis intervention flag is then set to 2. Note that the system never returns to the "welded contact safety" routine after it has gotten into "save the compressor" unless the entire system is reset. The "save the compressor" routine begins subsequent processing at the second conditional statement (if (cmp_cond_of_sto_in_crisis_mode=COND_STO_CRISIS_MODE_COOLING)) and proceeds through from there, rechecking the space temperature and reversing the operating mode when the appropriate boundary is penetrated.

While one advantageous embodiment has been chosen to illustrate the invention, it will be understood by those skilled in the art that various modifications can be made therein without departing from the scope of the invention as defined in the appended claims.

Appendix
Program Listing:
check_for_a_welded_contacts_cmp ()

```
        {
        /* LOCAL DATA */
        long time_since_change ();
      /* ************************ */

      /* INITIALIZE SAFETY CONDITIONS VARIABLE */
      /* TO ZERO AT THE FIRST EPOCH            */
A*      if (t_time_since_restart < 8L)
        {
B*         b_safety_conditions = 0;
           return;
        }

      /* GET OUT OF THE ROUTINE IF SAFETY ALREADY EXISTS */
C*      if (b_safety_conditions >= 0x0301)
        {
           return;
        }

/* + */
```

```
D*      if (t_time_since_restart <= ((7 MINS) + 4L))
        {
E1         if ((Initial_epoch)
E2            && (t_time_since_restart < 12L))
           {
Fa            temperature_t_dis_at_boot_up = f_temperature[N_TDIS];
Fb            temperature_t_liq_at_boot_up = f_temperature[N_TLIQ];
Fc            d_request_to_enable[N_WELDED_CONTACTS_SAFETY] =
                                        (M_P1:M_P2);
Fd            d_request_to_disable[N_WELDED_CONTACTS_SAFETY] =
                                        (M_RFV);
Fe            reversing_valve_mode = ZERO;
Ff            time_out_flag = W_FALSE;
           }

G1         if (((Initial_epoch)
G2            && (f_temperature[N_TDIS] > 140.0)
G3            && (f_temperature[N_TDIS] >= (temperature_t_dis_at_
                                        boot_up - 10.0))
G4            && (f_temperature[N_TLIQ] < (f_temperature[N_TAMB]
                                        - 20.0))
G5            && (f_temperature[N_TLIQ] < (temperature_t_liq_at_
                                        boot_up - 10.0))
G6            && (f_temperature[N_TAMB] > 50.0))
H1         :: ((Initial_epoch)
H2            && (f_temperature[N_TDIS] > 140.0)
H3            && (f_temperature[N_TDIS] >= (temperature_t_dis_at_
                                        boot_up - 10.0))
H4            && (f_temperature[N_TLIQ] < (f_temperature[N_TAMB]
                                        -15.0))
H5            && (f_temperature[N_TLIQ] < (temperature_t_liq_at_
                                        boot_up - 5.0))
H6            && (f_temperature[N_TAMB] <= 50.0)))
           {
I             b_crisis_intervention_flag = W_TRUE;
J*            if ((w_hoc_knob_on_off & M_COOL_SWITCH) == 1)
              {
K                b_safety_conditions := M_SAF_CMP_WELDED_CONTACTS_
                                        COOLG;
              }
              else
              {
L                b_safety_conditions := M_SAF_CMP_WELDED_CONTACTS_
                                        HEATG;
              }
           }

/* + */

           else
           {
M1            if ((Initial_epoch)
M2               && (t_time_since_restart > (4 MINS))
M3               && (f_temperature[N_TDIS] < 130.0))
              {
```

```
Na              d_request_to_enable[N_WELDED_CONTACTS_SAFETY] = 0;
Nb              d_request_to_disable[N_WELDED_CONTACTS_SAFETY] = 0;
             }
             else
             {
O1              if ((Normal_epoch)
O2                 && (t_time_since_restart >= (7 MINS))
O3                 && (d_request_to_enable[N_WELDED_CONTACTS_SAFETY]
                                   != 0)
O4                 && (d_request_to_disable[N_WELDED_CONTACTS_
                                   SAFETY] != 0))
                {
P1                 if ((f_temperature[N_TDIS] < 140.0)
P2                 && (f_temperature[N_TDIS] < (temperature_t_dis_
                                   at_boot_up + 5.0))
P3                 && (f_temperature[N_TLIQ] > (f_temperature[N_
                                   TAMB] - 15.0)))
                   {
Qa                    d_request_to_enable[N_WELDED_CONTACTS_
                                   SAFETY] = 0;
Qb                    d_request_to_disable[N_WELDED_CONTACTS_
                                   SAFETY] = 0;
                   }
                   else
                   {
R                     b_crisis_intervention_flag = M_TRUE;
S*                    if ((w _hoc_knob_on_off & M_COOL_SWITCH) == 1)
                      {
T                        b_safety_conditions := M_SAF_CMP_WELDED_
                                   CONTACTS_COOLG;
                      }
                      else
                      {
                         b_safety_conditions := M_SAF_CMP_WELDED_
                                   CONTACTS_HEATNG;
                      }
                   }
                }
             }
          }
       }

       else
       { /* Epoch type is normal and system on more than */
         /* 7 MINS and 4 seconds                          */

V*     if (devices_on(M_CMP))
       {
W      d_request_to_enable[N_WELDED_CONTACTS_SAFETY] = M_P1;
X*     if ((time_since_change(N_RFV) < (5 MIN))
Y*     :: (time_since_change(N_CMP)  < (5 MIN)))
       {
Za        f_high_t_liq_temperature = f_temperature[N_TLIQ];
Zb        f_low_t_liq_temperature = f_temperature[N_TLIQ]
       }
```

```
AA1     if (((The_HOC_is_set_for_COOLING_mode)
AA2        && (devices_on(M_RFV)))
BB1     :: (((d_request_to_enable[N_DEFROST] & M_RFV) != 0)
BB2        && (devices_on(M_RFV))))
        {
CC         d_request_to_enable[N_WELDED_CONTACTS_SAFETY) := M_RFV;
DD*        if (f_high_t_liq_temperature < f_temperature[N_TLIQ])
EE            f_high_t_liq_temperature = f_temperature[N_TLIQ];
FF*        if (i_cond_mode == I_COOLING_MODE)
           {
GG            reversing_valve_mode = RFV_COOLING;
              ;
HH            if (time_cmp_has_been_on_mod_15_min == 0)
II               f_high_t_liq_temperature = f_sys_temps[N_AVG_TLIQ];
           }
           else /* i_cond_mode != I_COOLING_MODE , maybe cooling */
                /* switched to off */
           {
JJ            if (reversing_valve_mode == RFV_HEATING)
              {
KK               reversing_valve_mode = RFV_DEFROST;
              }
           }
        }

        else  /* Reversing valve is off */

        {
LL         d_request_to_enable[N_WELDED_CONTACTS_SAFETY] &=
                                          ~(M_RFV);
MM*        if (f_low_t_liq_temperature > f_temperature[N_TLIQ])
NN            f_low_t_liq_temperature = f_temperature[N_TLIQ];
OO*        if (Heat_pump_rcvg_fm_defrost_cycle)
           {
PP            reversing_valve_mode = RFV_RECOVERY;
           }

           else /* DEFAULT TO HEATING MODE OR THE OFF */
                /* MODE, RFV NOT ENERGIZED            */
           {
QQ            reversing_valve_mode = RFV_HEATING;
RR1           if ((time_since_change(N_RFV) > (30 MINS))
RR2           && (time_cmp_has_been_on_mod_15_min = 0))
SS            f_low_t_liq_temperature = f_sys_temps[N_AVG_TLIQ];
           }
        }
    }

/* + */

        else /* COMPRESSOR IS OFF TO GET INTO THIS PORTION */
             /* OF THE CODE */
        {
TT*        if_time_since_change(N_CMP) < (2L * I_ESZS))
           {
UUa          time_out_flag = W_FALSE;
```

```
UUb          tdis_temperature_at_shutdown = f_temperature[N_TDIS];
           }

VV1a       if ((d_request_to_enable[N_WELDED_CONTACTS_SAFETY] != 0)
VV1b          && (time_since_change(N_CMP) < (10 MINS)))
        {
VV2a       if ((f_temperature[N_THX1W] >= 115.5)
VV2a       :: (f_temperature[N_THX1W] <= 27.5))
           {
VV2b          d_request_to_enable[N_WELDED_CONTACTS_SAFETY]
                                        := M_SPF;
           }

WW*        if (reversing_valve_mode ==RFV_HEATING)
           {
XX1           if ((f_temperature[N_TDIS] > (tdis_temperature_at_
                                        shutdown - 10.0))
XX2           && (f_temperature[N_TLIQ] < (f_low_t_liq_temperature
                                        - 5.0)))
           {
YYa            b_safety_conditions := M_SAF_CMP_WELDED_CONTACTS_HEATG;
YYb            b_crisis_intervention_flag = W_TRUE;
           }
ZZ1           else if ((f_temperature[N_TDIS] <
                        (tdis_temperature_at_shutdown - 10.0))
ZZ2              && (f_temperature[N_TLIQ] > f_low_t_liq_temperature))
AAA              d_request_to_enable[N_WELDED_CONTACTS_SAFETY] = 0;
           }


BBB*       if (reversing_valve_mode == RFV_COOLING)
           {
CCC1          if ((f_temperature[N_TDIS] > (tdis_temperature_
                                        at_shutdown - 10.0))
CCC2          && (f_temperature[N_TLIQ] > (f_high_t_liq_temperature
                                        + 5.0)))
           {
DDDa             b_safety_conditions := M_SAF_CMP_WELDED_
                                        CONTACTS_COOLG;

DDDb             b_crisis_intervention_flag = W_TRUE;
           }
EEE1          else if ((f_temperature[N_TDIS] <
                        (tdis_temperature_at_shutdown - 10.0))
EEE2             && (f_temperature[N_TLIQ] <
                                f_high_t_liq_temperature))
FFF*             d_request_to_enable[N_WELDED_CONTACTS_SAFETY] = 0;
           }
GGG*       if (reversing_valve_mode == RFV_DEFROST)
           {
HHH1          if ((f_temperature[N_TDIS] >(tdis_temperature_
                                        at_shutdown - 2.0))
HHH2          && (f_temperature[N_TLIQ] > (f_high_t_liq_
                                        temperature + 10.0))
HHH3          && (f_high_t_liq_temperature > 45.0))
           {
```

```
IIIa            b_safety_conditions :=M_SAF_CMP_WELDED_
                                      CONTACTS_DFRST;
IIIB            b_crisis_intervention_flag = W_TRUE;
              }
JJJ*          else if (f_temperature[N_TDIS] < (tdis_temperature_
                                      at_shutdown - 20.0))
KKK             d_request_to_enable[N-WELDED_CONTACTS_SAFETY] = 0;
          }

/* + */

LLL*      if (reversing_valve_mode == RFV_RECOVERY)
          {
MMM1         if ((f_temperature[N_TDIS] > (tdis_temperature_
                                      at_shutdown - 10.0))
MMM2         && (f_temperature[N_TLIQ] < (f_low_t_liq_
                                      temperature - 15.0))
MMM3         && (time_since_change(N_CMP) >= (5 MINS)))
             {
NNNa            b_safety_conditions := M_SAF_CMP_WELDED_CONTACTS_
                                      RCVRY;
NNNb            b_crisis_intervention_flag = W_TRUE;
             }
OOO*         else if (f_temperature[N_TDIS] < (tdis_temperature_
                                      at_shutdown - 20.0))
PPP             d_request_to_enable[N_WELDED_CONTACTS_SAFETY] = 0;
          }
       }
       else
       {
QQQ1    if ((time_since_change(N_CMP) >= (10 MINS))
QQQ2      && (d_request_to_enable[N_WELDED_CONTACTS_SAFETY] != 0)
QQQ3      && (f_temperature[N_TDIS] <= 100.0))
        {
RRRa         d_request_to_enable[N_WELDED_CONTACTS_SAFETY] = 0;
RRRB         time_out_flag = W_TRUE;
        }
        else

/* + */

        {
SSS1      if ((d_request_to_enable[N_WELDED_CONTACTS_SAFETY] == 0)
SSS2         && (time_out_flag == W_TRUE)
SSS3         && (f_temperature[N_TDIS] > 110.0))
          {

TTT*         if (reversing_valve_mode == RFV_HEATING)
             {
UUUa            b_safety_conditions := M_SAF_CMP_WELDED_CONTACTS_
                                      HEATG;
UUUb            b_crisis_intervention_flag = W_TRUE;
             }
VVV*         if (reversing_valve_mode == RFV_COOLING)
             {
WWWa            b_safety_conditions := M_SAF_CMP_WELDED_CONTACTS_
                                      COOLG;
```

```
WWWb            b_crisis_intervention_flag = w_TRUE;
              }
XXXX          if (reversing_valve_mode == RFV_DEFROST)
              {
YYYa            b_safety_conditions := M_SAF_CMP_WELDED_CONTACTS_
                                       DFRST;
              }
ZZZ*          if (reversing_valve_mode == RFV_RECOVERY)
              {
AAAAa           b_safety_conditions := M_SAF_CMP_WELDED_CONTACTS_
                                       RCVRY;
AAAb            b_crisis_intervention_flag = W_TRUE;
              }
          }
      }
      }
      }
      }
      }


SAVE_THE_COMPRESSOR

cond_the_sto_to_save_the_cmp ()

{
/* LOCAL DATA */
static t_int cmp_cond_of_sto_in_crisis_mode;
t_dev     temporary;
t_sreg    high_byte;
t_sreg    low_byte;
t_int     i;

#define M_LOW_BYTE 0377
/* The various modes of the compressor in the crisis mode */
#define COND_STO_CRISIS_MODE_HEATING 1 /* Crisis mode heating */
                                       /* of the storage.     */
#define COND_STO_CRISIS_MODE_COOLING 2 /* Crisis mode cooling */
                                       /* of the storage.     */

/* ************************************************** */


/* SET THE CRISIS CONDITIONING MODE IF THIS IS */
/* THE FIRST TIME THROUGH THE ROUTINE          */

    if (b_crisis_intervention_flag == 1)
       {
       cmp_cond_of_sto_in_crisis_mode = COND_STO_CRISIS_
                                       MODE_HEATING;
       if ((b_safety_conditions == M_SAF_CMP_WELDED_CONTACTS_
                                       DFRST)
       :: (b_safety_conditions == M_SAF_CMP_WELDED_CONTACTS_
                                       HEATG))
          }
          cmp_cond_of_sto_in_crisis_mode == COND_STO_CRISIS_
                                       MODE_COOLING;
```

```
        }
      }
    if (cmp_cond_of_sto_in_crisis_mode == COND_STO_CRISIS_
                                          MODE_COOLING)
      {
      d_device_contacts = M_P1:M_P2:M_OAF:M_PFV:M_SPF;
      }
    else /* cmp_cond_of_sto_in_crisis_mode =  */
         /* COND_STO_CRISIS_MODE_HEATING */
      {
      d_device_contacts = M_P1:M_P2:m_OAF:M_SPF;
      }

/* + */

    /* Check to see if the cooling boundaries have */
    /* been exceeded */

    if ((f_temperature[N_TRETA] <= (f_hoc_setting[N_
                                          SETPDEGR] - 5.0))
    :: (f_temperature[N_TRETA] <= 65.0))
      {
      cmp_cond_of_sto_in_crisis_mode = COND_STO_CRISIS
                                          MODE_HEATING;
      d_device_contacts = M_P1:M_P2:M_OAF:M_SPF;
      }

    /* Check to see if the heating boundaries have */
    /* been exceeded */

    if ((f_temperature[N_TRETA] >= (f_hoc_setting[N_
                                          SETPDEGR] + 5.0))
    :: (f_temperature[N_TRETA] >= 78.0))
      {
      cmp_cond_of_sto_in_crisis_mode = COND_STO_CRISIS_
                                          MODE_COOLING;
      d_device_contacts = M_P1:M_P2:M_OAF:M_SPF:M_PFV;
      }

/* + */

/* Get the bits in the correct order */

    /* Force the lights on for the crisis mode */

temporary = 0;
if (s_do2 == 0xF9)
{
    temporary := M_DOSLIT;
    d_device_contacts := M_SLIT;
}
else
{
temporary := M_DOSLIT;
temporary := M_DOAPCD;
temporary := M_DOSBIB;
```

```
temporary := M_DOALIT;
temporary := M_DOPLIT;
d_device_contacts := M_SLIT;
d_device_contacts := M_APCD;
d_device_contacts := M_SBIB;
d_device_contacts := M_ALIT;
d_device_contacts := M_PLIT;
}
if ((M_RFV & d_device_contacts) != 0) temporary := M_DORFV;
if ((M_P1  & d_device_contacts) != 0) temporary := M_DOP1;
if ((M_OAF & d_device_contacts) != 0) temporary := M_DOOAF
if ((M_P2  & d_device_contacts) != 0) temporary := M_DOP2;
if ((M_SPF & d_device_contacts) != 0) temporary := M_DOSPF;

/* Modify the digital output word */

    high_byte = ((temporary>>8) & M_LOW_BYTE);
    low_byte = (temporary & M_LOW_BYTE);
    s_do_1 = low_byte;
    s_do_2 = high_byte;
    b_crisis_intervention_flag = 2;
}
```

What is claimed is:

1. A method of controlling a heating and cooling system of the type having a compressor, first and second heat source and heat sink locations, heat exchangers connected to exchange heat with the source and sink locations and conduit means for conducting refrigerant flowing between the compressor and exchangers, comprising the steps of monitoring at least one selected parameter of the system during operation to determine conditions under which the system compressor should be deenergized, determining when compressor operation has not ended under those conditions, thereby indicating a "welded contact" failure, and initiating a safety mode of operation in response to the detection of a welded contact failure, the safety mode including maintaining a proper load on the compressor adequate to prevent compressor self-destruction until corrective action can be taken.

2. A method according to claim 1 wherein the at least one selected parameter includes the discharge temperature of the compressor.

3. A method according to claim 2 wherein the at least one selected parameter includes the temperature of the refrigerant in one system heat exchanger.

4. A method according to claim 3 wherein the system includes a reversing valve and wherein the safety mode includes repetitively reversing the state of the system reversing valve to maintain a load on the compressor.

5. A method according to claim 1 wherein the at least one selected parameter includes the temperature of the refrigerant in one system heat exchanger.

6. A method according to claim 5 wherein the system includes a reversing valve and wherein the safety mode includes repetitively reversing the state of the system reversing valve to maintain a load on the compressor.

7. A method according to claim 1 wherein the system includes a reversing valve and wherein the safety mode includes repetitively reversing the state of the system reversing valve to maintain a load on the compressor.

8. A method according to claim 1 wherein the determination of when compressor operation has not ended includes sensing the continued exchange of energy with the refrigerant.

9. A method according to claim 1 wherein the determination of when compressor operation has not ended includes sensing the energy which continues to be extracted from and/or added to refrigerant liquid.

10. A method according to claim 9 wherein the system includes a reversing valve and wherein the safety mode includes repetitively reversing the state of the system reversing valve to maintain a load on the compressor.

* * * * *